US005529144A

United States Patent [19]

Henderson

[11] Patent Number: 5,529,144

[45] Date of Patent: Jun. 25, 1996

[54] STEEL WORKER'S SAFETY CLAMP

[76] Inventor: Matt G. Henderson, 19127 Edgehill Pl., Culpeper, Va. 22701

[21] Appl. No.: 288,769

[22] Filed: Aug. 11, 1994

[51] Int. Cl.[6] ..... A62B 35/00

[52] U.S. Cl. ..... 182/3; 248/231.41

[58] Field of Search ..... 182/3, 45; 248/237, 248/231.4; 74/89.13

[56] References Cited

U.S. PATENT DOCUMENTS

| | | | |
|---|---|---|---|
| 392,560 | 11/1888 | Hromas | 74/89.13 |
| 1,315,852 | 9/1919 | Mitchell | 248/231.4 |
| 2,805,103 | 9/1957 | Jovais | 182/113 X |
| 3,961,765 | 6/1976 | Brothers | 248/231.4 X |
| 4,466,596 | 8/1984 | Cohen | 248/231.4 X |
| 4,928,789 | 5/1990 | Claeys . | |
| 5,029,670 | 7/1991 | Whitmer . | |
| 5,092,426 | 3/1992 | Rhodes . | |
| 5,150,768 | 9/1992 | Olson et al. . | |
| 5,156,233 | 10/1992 | Olsen et al. . | |
| 5,307,897 | 5/1994 | Turner et al. . | |
| 5,346,036 | 9/1994 | Arisman | 248/200.1 X |

FOREIGN PATENT DOCUMENTS

| | | |
|---|---|---|
| 3728282 | 3/1988 | Germany . |
| 2160571 | 12/1985 | United Kingdom . |
| 2256002 | 11/1992 | United Kingdom . |
| WO93/16256 | 8/1993 | WIPO . |

*Primary Examiner*—Alvin C. Chin-Shue
*Attorney, Agent, or Firm*—Richard C. Litman

[57] ABSTRACT

A clamp for anchoring a safety tether to an I-beam. Two opposed jaws are drawn together and spread apart by turning a screw passing through both jaws. The screw is journaled in one jaw and threaded into and entirely through the other jaw. The screw is positively retained to both jaws, so that the clamp is prevented from separating into two constituent parts. The jaws are arranged to remain properly aligned with one another. Because of the fixed alignment of the jaws and the single part construction, the clamp is readily placed in position by a steelworker. In a preferred embodiment, a cranked handle is geared to the screw, so that the screw can be turned from directly above the clamp. This avoids the necessity of reaching out to either side of the beam, above open space high up on a building skeleton. The jaws are configured to accommodate I-beam or H-beam flanges of different thicknesses. An eye bolt enables attachment to a safety tether. Provision may be made for accepting a plurality of eye bolts. The worker may tether to a novel clamp, or may tether to a line strung between two or more clamps.

10 Claims, 3 Drawing Sheets

STEEL WORKER'S SAFETY CLAMP

BACKGROUND OF THE INVENTION

1. Field of the Invention

The present invention relates to a safety clamp for anchoring a worker's safety tethering line to the skeleton of a building under construction. The clamp has jaws engaging the flanges of an I-beam, and an eye for receiving the tethering line or a component thereof, such as a snap hook.

2. Description of the Prior Art

The prior art has taken notice of the problem of protecting personnel working high above the ground on large structures. This situation is most frequently encountered in the field of construction of tall buildings. .A skeleton of steel members, such as I-beams and the like, is first erected. The balance of the building is supported by the skeleton.

Workers constructing and finishing the skeleton and building subsequent structures, such as poured concrete floor slabs, must work and be supported on the open skeleton. There is usually no floor, either temporary or final, to catch the worker should he or she fall.

Conventional prior art practice includes, among other measures, tethering a worker to the structure. This practice requires the presence of convenient anchor points secured to the skeleton.

An anchor and associated ancillary apparatus for this purpose is disclosed in U.S. Pat. No. 4,928,789, issued to Shane C. Claeys on May 29, 1990. The anchor comprises two jaws, essentially L-shaped, which are mutually connected, and adjusted toward and away from one another, by a screw. The screw is journaled in one jaw, and threads into the other.

U.S. Pat. No. 5,307,897, issued to C. Rockwell Turner et al. on May 3, 1994, discloses a stanchion attachable to an I-beam. The stanchion requires attachment at two points to the I-beam. At one of these points, a member is clamped to the I-beam by a screw secured in place by a lock nut. At the other point, a jaw engaging an I-beam flange is held in place by ratchet action.

This invention is large and cumbersome, and not readily deployed. Also, clamping apparatus operates differently from that of the present invention.

U.S. Pat. No. 5,092,426, issued to C. Anthony Rhodes on Mar. 3, 1992, discloses a safety system having a main channel member spanning two separated I-beams. This system requires a clamp or equivalent attachment at each of the two I-beams. Hooks for engaging the I-beam comprise right angled members, which are draped over horizontally and vertically arranged beams. This arrangement will not work with diagonally oriented beams, as will be encountered with wind brace beams. The hooks are also potentially susceptible to displacement from beneath, as might occur if a crane were being operated in the vicinity.

In the present invention, the hooks surround the I-beam. They are not dependent upon horizontal or vertical orientation, and are usable with diagonally disposed members.

The Rhodes invention is heavy, long, has projecting levers which are difficult to reach, and is difficult to maneuver, especially by one person.

U.S. Pat. No. 5,029,670, issued to Gerald T. Whitmer on Jul. 9, 1991, discloses a safety system which clamps to structural steel members and anchors a safety tether line. This system employs individual units which clamp to the flange of an I-beam or the like. In a fashion similar to that of the present invention, each unit has a jaw slidably mounted upon a square channel fastened to an opposing or corresponding jaw.

However, each unit is secured to the I-beam by two connections. In the first connection, opposed jaws are fastened in place by tightening a threaded fastener anchored within the movable jaw into the square channel, in the manner of a setscrew. In the second connection, a sandwich arrangement pinches the flange of the I-beam to the assembly including the stationary jaw.

This arrangement is considerably more cumbersome than the present invention, and relies on setscrew type connections for adherence to the I-beam.

A safety anchor accepting a tether line which anchor interfits slotted structural beams is seen in U.S. Pat. No. 5,156,233, issued to Gene E. Olson et al. on Oct. 20, 1992. This device works well within its intended application, but lacks means for clamping to ordinary structural members which do not have the specific slot with which this invention interfits.

P.C.T. Application No. PCT/US93/00960, dated Aug. 19, 1993, and U.K. Pat. Application No. 2,256,002, dated Nov. 25, 1992, disclose systems of anchors and associated safety tethering cables. These patents teach the use of one safety line strung among plural anchors, and separate tethering of a worker to the one safety line. These anchors are not disclosed as being similar to those of the present invention.

None of the above inventions and patents, taken either singly or in combination, is seen to describe the instant invention as claimed.

SUMMARY OF THE INVENTION

The present invention provides a safety clamp attachable to the flange of I-beams, H-beams, and the like. The inventive clamp comprises two opposed jaws, which are drawn together and spread apart by turning a screw, in a manner similar to the device of Claeys. However, the present invention improves significantly over the prior art device of Claeys.

Firstly, the screw passes entirely through the two jaw members, and is prevented from disengaging therefrom. This arrangement leads to the significant characteristic that the clamp always remains unitary. The likelihood of losing one part is significantly reduced.

Also, the jaws interfit, so that mutual rotation is prevented. As a consequence of this characteristic, and of its unitary nature, the novel clamp can be set in place over the flange of an I-beam with only one hand.

Installation is accomplished with considerably more attention and effort in the case of Claeys. First, the two jaws must be assembled, if separated. Next, the jaws must be held in alignment with respect to the plane of the flange while the screw is tightened. When removing the tool, attention must be paid to avoid separating and dropping one jaw member.

In another improvement over Claeys, the jaws have lateral surfaces for contacting the flange arranged at an angle to one another, rather than parallel. This accommodates flanges of different thickness dimensions.

The clamp includes a frame including a threaded hole, for accepting an eye bolt. A safety tether line is attached to the clamp at the eye bolt. Additional holes are provided, for tapping or for welding a nut thereto, so as to accommodate additional eye bolts.

In one embodiment, the screw is driven from a cranked handle through a bevel gear arrangement. The handle is located above the clamp, and in vertical registry with the I-beam. The handle thus can be turned from above the I-beam, and does not require the user to reach out to the side of the I-beam, above open space and potentially high above the ground.

The novel clamp is employed either singly, or in groups of at least two. In the first method of use, the worker tethers directly to the eye bolt. In the second method of use, a line is strung from clamp to clamp, and the worker tethers to the line. The latter arrangement gives the worker greater range of motion, since the tether line to tether line connection is slidable.

The use of plural clamps also enables one clamp to remain firmly fastened at all times, even when a second clamp is being moved to a new location.

Accordingly, it is a principal object of the invention to provide a clamp manually attachable to and removable from the flange of an I-beam.

It is another object of the invention to ensure that the clamp remain a unitary assembly.

It is a further object of the invention to cause the jaws to remain aligned automatically, so that there is no necessity to occupy one hand of a user to accomplish this when installing the clamp on an I-beam.

Still another object of the invention is to provide at least one eye for attachment of a safety tether line.

An additional object of the invention is to provide accommodation of more than one eye for attachment of tether lines.

It is again an object of the invention to provide an I-beam clamp which is uncomplicated and compact.

Yet another object of the invention is to provide a clamping arrangement which can be employed singly, for direct tethering of a person thereto.

Still a further object of the invention is to provide a clamping arrangement wherein a line is strung between at least two clamps, enabling a person to tether to the line.

It is still an additional object of the invention to drive the screw by a rotatable handle operably connected thereto.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1, 1A:
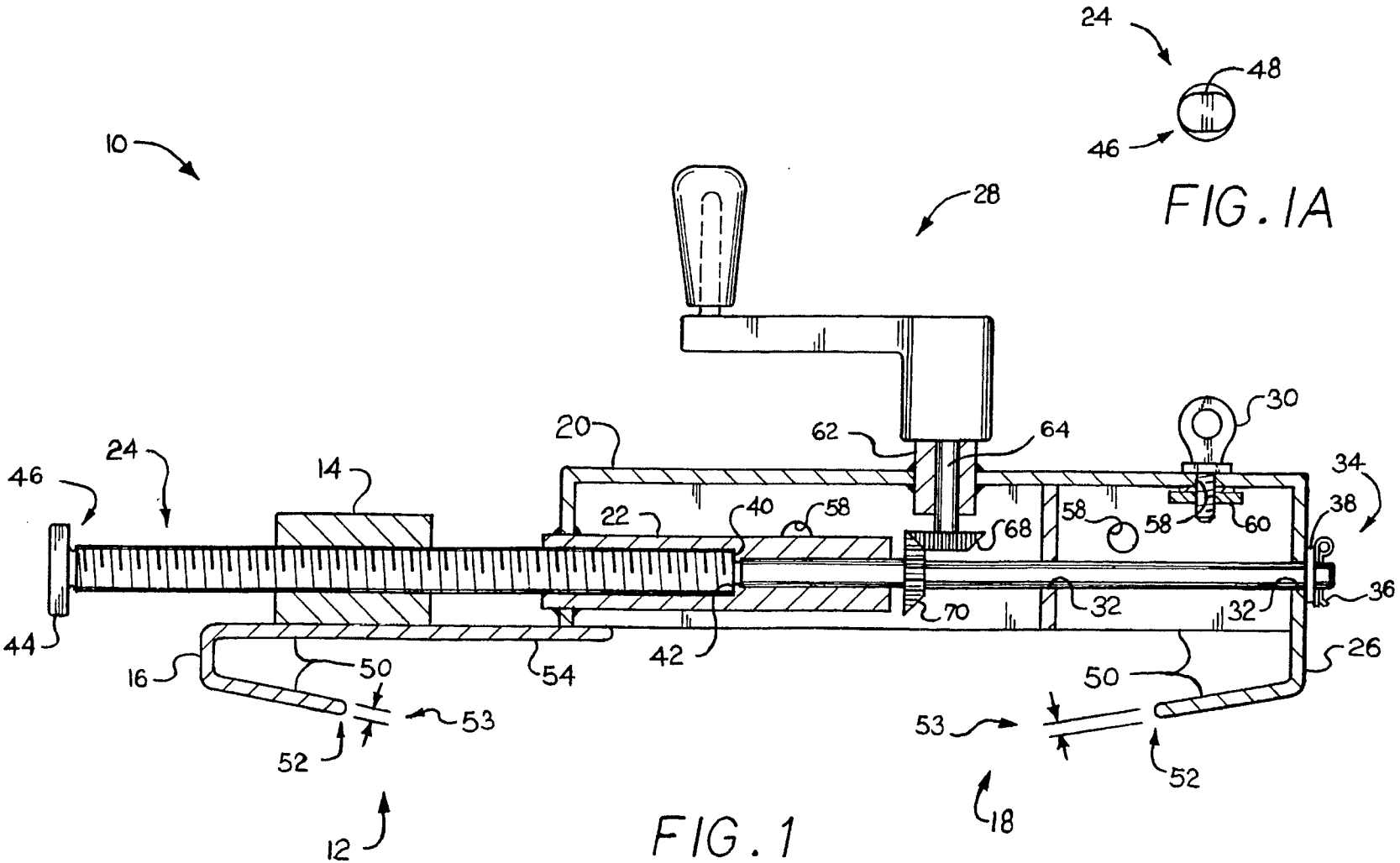
FIG. 1 is a cross sectional, side elevational view of the novel clamp.
FIG. 1A is an end elevational detail view of an alternative embodiment of the screw, as seen from the left side of FIG. 1.

Turning now to FIG. 1 of the drawings, clamp 10 includes a first jaw member 12, comprising a threaded block 14 and a jaw 16. An opposed second jaw member 18 includes a frame 20 supporting a hollow member 22 in which a screw 24 is journaled, a second jaw 26, a cranked handle 28, and an eye bolt 30.

Screw 24 is threaded for only a portion of its overall length, the threaded portion engaging block 14. The balance of the overall length is accounted for by a smooth walled portion of reduced diameter, enabling a close yet rotatable fit within hollow member 22 and also within holes 32 formed in frame 20. Hollow member 22 has a smooth walled bore accommodating screw 24 at both the threaded portion of full diameter, and the smooth walled portion of reduced diameter. Thus, screw 24 operably engages both jaw members 12,18, passing entirely through both.

At distal end 34 of screw 24, a bore (not shown) accommodates a cotter pin 36 inserted therethrough. Washer 38 prevents cotter pin 36 from binding on or being damaged by screw 24 when screw 24 is being turned.

Screw 24 forms a shoulder 40 at the point of transition of full to reduced diameter. Shoulder 40 abuts a corresponding shoulder 42 formed in hollow member 22. Interference fit of shoulder 40 to shoulder 42, combined with cotter pin 36 and associated washer 38, prevent screw 24 from disengaging jaw member 18.

Jaw member 12 is prevented from disengaging from screw 24 by virtue of its position entrapped between jaw member 18, and an enlarged head 44 fixed to proximal end 46 of screw 24.

A second method for maintaining jaw member 12 engaged with screw 24 is illustrated in FIG. 1A. Distorting proximal end 46, and particularly distorting threads 48 formed thereon, will prevent block 14 from unthreading from screw 24.

Again referring to FIG. 1, jaw members 12 and 18 each include respective jaws 16,26. Jaws 16 and 26 each have two flange contacting surfaces 50 arranged at an acute angle to one another, so that when safety clamp 10 is tightened onto the flange of an I-beam. (not shown), the flange will contact each jaw 16 or 26 at a minimum of two points. The angle accommodates flanges of different thicknesses, within a range determined by the maximum spread of each jaw 16 or 26, maximum spread being indicated generally at 52.

Jaws 16 or 26 are preferably made from steel stock of thickness limited to approximately one quarter inch (6 mm). This thickness, indicated at 53, provides sufficient strength to support most people in the event of a fall, but also enables engagement of jaws 16,26 to various structural members (not shown). Although generally ressembling I-beams, some structural members are made up from channels arranged back to back, and separated by spacers. This construction leaves a gap between the channels. Jaws 16,26 will therefore be able to engage such structural members so that clamp 10 may be clamped thereto even when no flange is formed thereon in the manner of I-beams and H-beams.

Examination of FIG. 1 will reveal that an extension 54 of jaw member 12 is disposed just beneath frame 20 of jaw member 12. Extension 54 has a planar top surface disposed in substantially parallel relation to the bottom surfaces of frame 20. When tightening of screw 24 draws extension 54 into underlying relationship to frame 20, ensuing near abutment with frame 20 constrains extension 54 against rotation about screw 24. Thus, jaw members 12 and 18 are maintained aligned. The consequence of this alignment is that clamp 10 can be installed on an I-beam flange without requiring manual effort to effect the necessary alignment.

Eye bolt 30 is passed through a hole 58 drilled into frame 20, and is secured in place by fasteners 60. A tether line (see FIG. 2) attaches to clamp 10 by passing through the opening of eye bolt 30, or alternatively, through hole 58. Additional holes 58 are located at various points along frame 20. Any hole 58 may be threaded to accept an eye bolt without requiring fasteners, if desired.

Frame 20 also supports a boss 62 welded thereto. Shaft 64 of cranked handle 28 is journaled within boss 62. A gear 68 fixed to shaft 64 meshes with a corresponding gear 70 fixed to screw 24. This arrangement permits screw 24 to be drivingly connected to a rotatable handle arranged at an angle thereto.

In an alternative embodiment, it would be possible to mount handle 28 to proximal end 46 of screw 24, if desired. In this alternative embodiment, handle 28 would serve in place of enlarged head 44 to prevent jaw member 12 from disengaging from screw 24. Gears 68 and 70 would be eliminated, and handle 28 would be accessed from the side of clamp 10.

Figure 2:
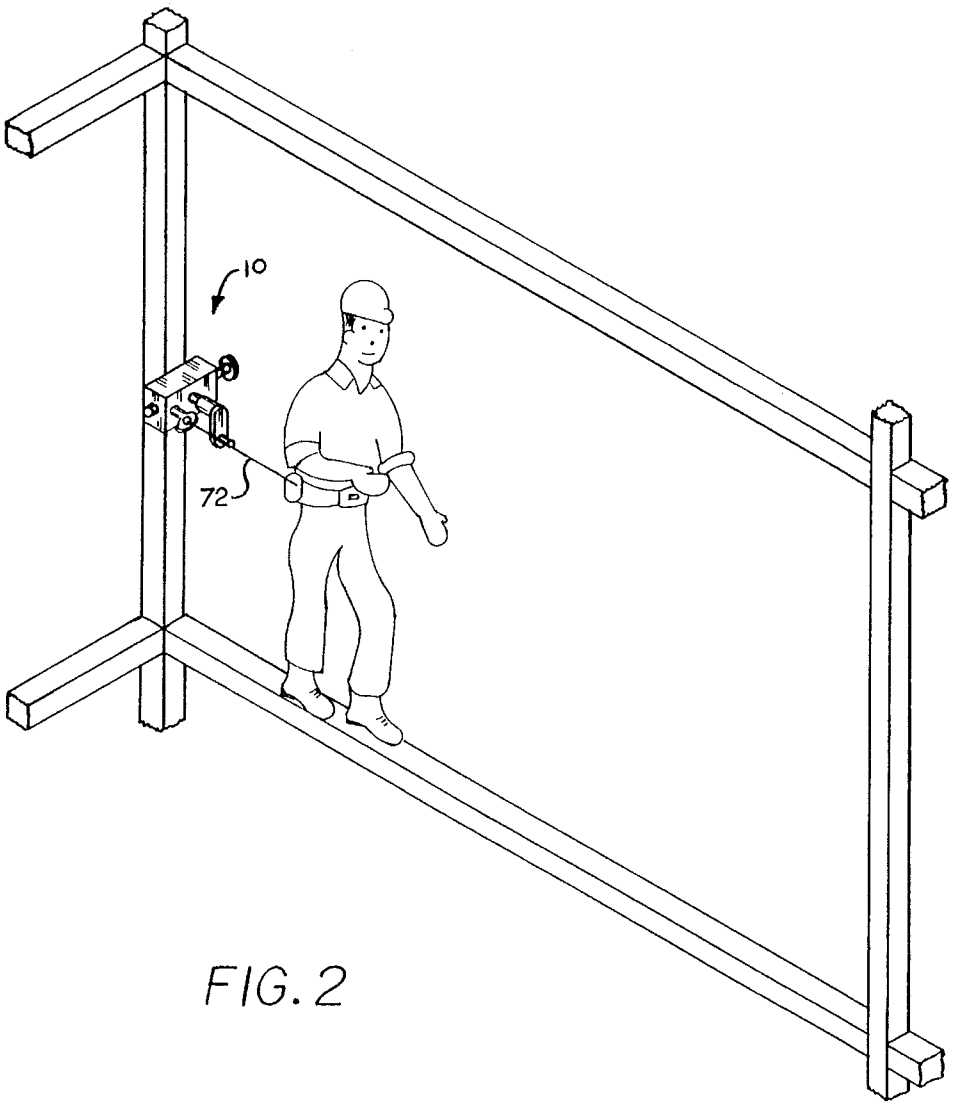
FIG. 2 is a diagrammatic perspective view showing tethering of a worker to one clamp.
Figure 3:
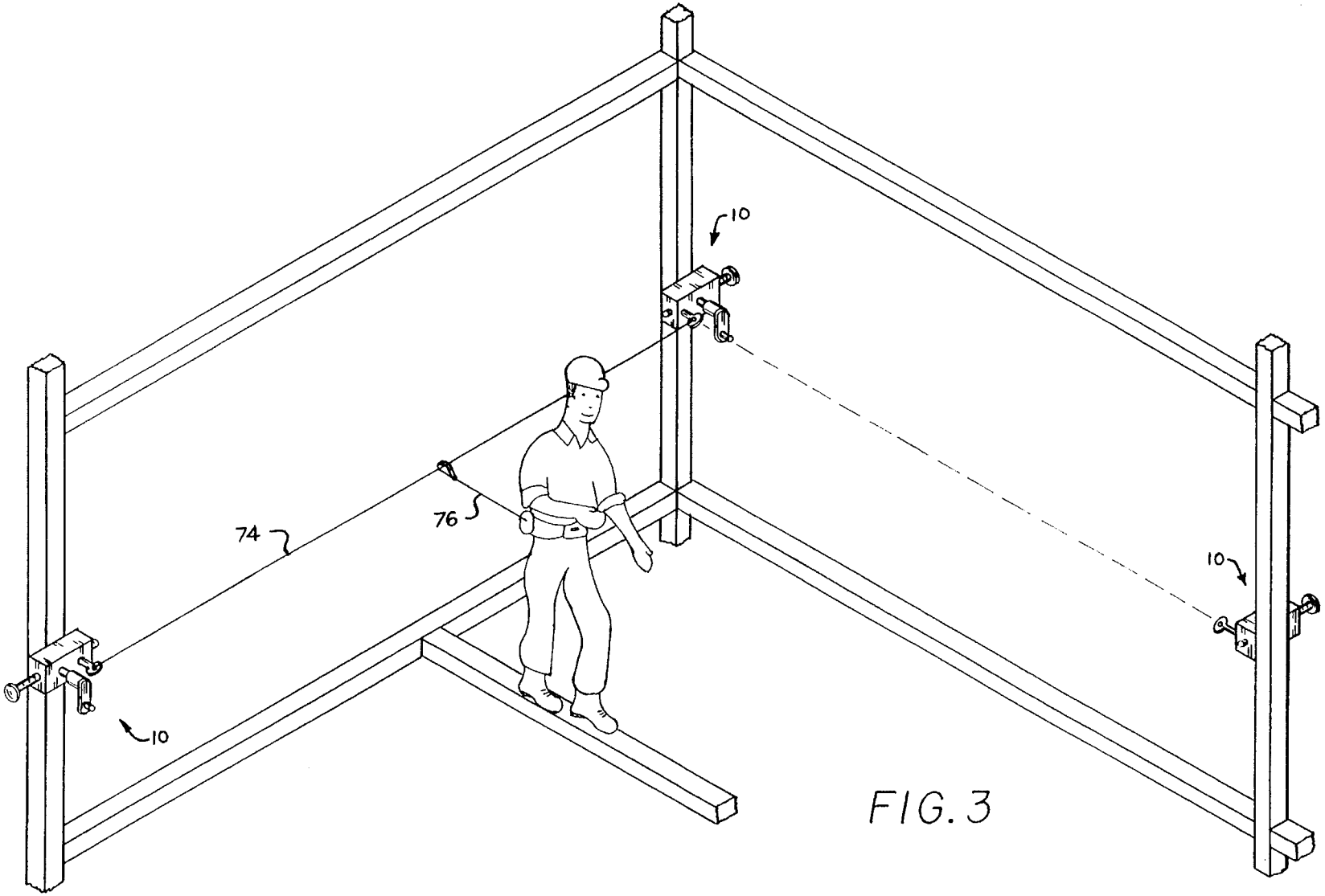
FIG. 3 is a diagrammatic perspective view showing a tethering arrangement wherein a first line is strung between two clamps, and a worker in turn tethers to the first line.

Preferred methods of using clamp 10 are illustrated in FIGS. 2 and 3. Novel clamp 10 may be employed singly, for direct attachment by a tether line 72, as seen in FIG. 2.

In a more advantageous application, shown in FIG. 3, a first tether line 74 is strung between two clamps 10. A second line 76 tethers a user to first tether line 74. The user enjoys greater range of motion using lines 74 and 76 than is possible employing a single line, as shown in FIG. 2.

Another advantage of the arrangement of FIG. 3 is that if line 74 is provided with a sufficiently large and strong attachment apparatus, such as a snap hook, then additional safety is provided when moving a clamp 10 from one beam to another, or when reattaching line 74. Should a user slip and fall while one end of line 74 were still anchored to a clamp 10, then the user would fall a distance limited to the combined lengths of lines 74 and 76. While a certain degree of hazard still exists, this situation would be preferable to allowing the user to fall many stories.

It is to be understood that the present invention is not limited to the embodiments described above, but encompasses any and all embodiments within the scope of the following claims.

I claim:

1. A safety clamp for attachment to a flange of a structural beam, comprising:

a frame;

a screw;

a first jaw member having a planar extension disposed beneath said frame, said first jaw member including a threaded block extending beyond said frame and engaging said screw in journaled relation thereto; and an opposed second jaw member formed integral with said frame, said screw passing entirely through said threaded block of said first jaw member and being rotatably secured to said second jaw member, said screw further including means for preventing disengagement of said screw from said threaded block; whereby upon rotation of the screw in a first direction, the planar extension is drawn into underlying relationship with the frame and prevented from rotating to maintain the first jaw member aligned with the second jaw member.

2. The safety clamp according to claim 1, each of said first jaw member and said second jaw member comprising flange contacting surfaces arranged at an angle to one another.

3. The safety clamp according to claim 1, said means for preventing disengagement comprising an enlarged head fixed to said screw.

4. The safety clamp according to claim 1, said means for preventing disengagement comprising distorted threads formed in said screw.

5. The safety clamp according to claim 1, further comprising means defining a hole formed in said frame for attachment of a tether line.

6. The safety clamp according to claim 5, said means defining a hole further comprising an eye bolt mounted therethrough.

7. The safety clamp according to claim 1, further comprising a rotatable handle journaled within said frame, and drivingly connected to said screw at an angle thereto.

8. The safety clamp according to claim 7, said rotatable handle comprising a cranked handle.

9. The safety clamp according to claim 8, said rotatable handle further including a first gear, and said screw further including a second gear meshing with said first gear, whereby said rotatable handle drives said screw through meshing gears.

10. The safety clamp according to claim 1, at least one of said first jaw and said second jaw having a thickness dimension limited to one quarter inch (6 mm).

* * * * *